US006082492A

United States Patent [19]

Yerger

[11] Patent Number: 6,082,492

[45] Date of Patent: Jul. 4, 2000

[54] SAFETY BELT FOR CLIMBING TREE STAND

[76] Inventor: Joseph W. Yerger, 1403 Johnson St., Tallulah, La. 71282

[21] Appl. No.: 08/848,913

[22] Filed: May 1, 1997

[51] Int. Cl.[7] ..... A45F 3/26

[52] U.S. Cl. ..... 182/136; 182/187

[58] Field of Search ..... 182/187, 188, 182/135–136, 3, 9; 602/19; 2/311, 312

[56] References Cited

U.S. PATENT DOCUMENTS

| | | | |
|---|---|---|---|
| 797,727 | 8/1905 | Gaisman . | |
| 1,504,030 | 8/1924 | Dettweiler | 182/9 |
| 2,381,114 | 8/1945 | Cox . | |
| 2,853,220 | 9/1958 | Thomas . | |
| 3,314,421 | 4/1967 | Wingard . | |
| 4,493,395 | 1/1985 | Rittenhouse | 182/187 |
| 4,890,694 | 1/1990 | Williams . | |
| 5,234,076 | 8/1993 | Louk et al. . | |
| 5,492,198 | 2/1996 | Williams | 182/187 |
| 5,588,499 | 12/1996 | Carriere . | |

OTHER PUBLICATIONS

Ol'Man Tree Stands Brochure, L&L Enterprises, Inc., 1993.

API Outdoors Inc. 1997 Brochure, API Outdoors of Tallulah, Louisiana.

Deer & Deer Hunting Magazine "Hunting from High Places" Magazine Section, "The Stand Safety Special", 1994.

Cabela's Fall 1996 Annual Catalog, pp. 270 through 276, 279, and 330.

Tree–Tech System Tree Stand Safety Belt advertisement, 1996.

*Primary Examiner*—Alvin Chin-Shue

*Attorney, Agent, or Firm*—Nixon & Vanderhye P.C.

[57] ABSTRACT

A tree stand safety belt facilitates climbing of a tree with a climbing tree stand without interfering with climbing movement of the tree stand, and while allowing the belt to be curled up when not in use. The belt body is made of a flexible web of cloth-like material, such as polyester or nylon webbing, and has first and second ends. An attachment device, such as a clip, is provided at the second end, and a loop is typically formed at the first end that allows the second end to pass through it. A stiffening element, such as a chain, is provided at a central portion of the belt between the first and second ends, for example sandwiched between a strip of webbing stitched to the belt body and the belt body itself. During use the belt is connected by a releasable attachment device (such as a spring clamp) to a side support or tree engaging element of the upper frame of a tree stand.

15 Claims, 3 Drawing Sheets

SAFETY BELT FOR CLIMBING TREE STAND

BACKGROUND AND SUMMARY OF THE INVENTION

Climbing tree stands are very popular with hunters and photographers of wildlife, and provide a very effective way to stay in an unobtrusive elevated position in a relatively comfortable and safe manner. While it is recommended that users of such tree stands always have a safety belt connected to them when climbing a tree with the tree stand, or when stationary in the tree stand up in the tree, climbing the tree with the safety belt attached is a very time consuming and cumbersome process because the flexible safety belt tends to interfere with the climbing action of the tree stand. This is frustrating enough that most hunters or photographers do not use a safety belt when climbing, but rather attach the safety belt only once actually in the tree (when climbing has stopped). However according to a survey by Deer and Deer Hunting magazine about half of the falls associated with tree stands occur when the user is ascending to or with the stand, or descending from or with the stand. Therefore it is very important for safety purposes that a safety belt be effectively employed even when climbing.

According to the present invention a tree stand safety belt is provided which overcomes the problems associated with the prior art constructions which interfere with climbing movement of the tree stand. This tree stand safety belt according to the invention does not significantly interfere with the climbing action of the tree stand, so that most users of tree stands will in fact use the safety belt while ascending or descending. Also the tree stand safety belt according to the invention can be curled up when not in use for easy storage, and transported along with the tree stand. The advantageous results according to the invention are accomplished primarily by providing a stiffening element at a central portion of the belt which prevents flopping action of the belt that can potentially be caught in the frame of the tree stand during climbing, and/or by providing means for releasably attaching the belt to at least one of the side supports of the tree stand upper frame.

According to one aspect of the present invention a tree stand safety belt is provided comprising the following elements: A belt body comprising a flexible web of cloth like material and having first and second ends. A loop formed at the first end of the belt body that allows the second end to pass through. An attachment device at at least one of the ends of the belt body that allows attachment to a tree stand user. And, a stiffening element at a central portion of the belt body between the first and second ends that stiffens the web to facilitate climbing of a tree with a tree stand without significantly interfering with climbing movement of the tree stand, while allowing the belt body to be curled up when not in use.

The stiffening element preferably comprises a chain, typically a stainless steel metal chain, connected to the belt body. The chain may be connected to the belt body by a strip of webbing stitched to the belt body and sandwiching the chain between the strip and the belt body. The belt body typically comprises polyester, cotton, aramid, or nylon webbing between about 1.5–4 inches wide, and the strip of webbing is also preferably polyester, cotton, aramid, or nylon webbing having an effective width of about 1.5–4 inches. Alternatively the stiffening element may comprise a length of cable, such as steel cable, or a generally rectangular strip of metal or plastic, such as conventional metal or plastic banding, or multiple thicknesses of webbing, and/or a cellulose material such as cardboard (sandwiched between pieces of webbing). Preferably the stiffening element is not so rigid or undesirably shaped so that it precludes curling of the belt for each storage and transport.

The attachment device may comprise a clip connected to the belt body second end by a connection that allows adjustment of the effective belt length. The clip normally connects to a conventional harness worn by the user (which harness, per se, is not part of the present invention). The attachment device is typically at the second end of the belt body, and a loop is formed at the first end of the belt body that allows the second end to pass therethrough. The loop may be formed by fastening one part of the belt body to another at the first end. Alternatively attachment means, e.g. such as clips for connection to a harness D-ring, may be provided at both ends of the belt body, although by providing a loop the belt will be more positively secured to the tree if the user falls.

According to another aspect of the present invention a safety belt for use with a tree stand is provided comprising the following components: A belt body of polyester, nylon, cotton, or aramid webbing having a width of between about 1.5–4 inches, first and second ends, a central portion between the first and second ends, and a length. A chain stiffening element having a length less than about half of the belt body length and a width less than the width of the belt body. A strip of polyester, nylon, cotton, or aramid webbing having an effective width of between about 1.5–4 inches and a length greater than the chain length and less than the belt body length. And, the strip of webbing fixed to the belt body at the central portion of the belt body so that the chain stiffening element is sandwiched between the belt body and the strip of webbing. The details of the belt, and belt ends, and attachment of the belt to a tree stand, may be provided as set forth above.

According to another aspect of the present invention a method of facilitating a human safely ascending or descending a tree using a tree stand having upper and lower frames each with side supports and a tree gripping element, and a safety belt connected to the human, is provided. The safety belt is as described above, and the method comprises the following steps: (a) Placing the tree stand in association with a tree so that the side supports of the upper and lower frames straddle the tree and the tree gripping elements are positioned to engage the tree. (b) Placing the stiffening-element-having central portion of the safety belt around the tree and outside of and substantially in contact with the upper frame tree gripping element. (c) Releasably connecting the safety belt to at least one side support or the tree gripping element of the upper frame of the tree stand. (d) Operatively attaching the safety belt to the human using the tree stand. And, (e) climbing up or down the tree using the tree stand while the safety belt is operatively attached to the human using the tree stand. And, wherein steps (b) and (c) are practiced so as to facilitate climbing of the tree with the tree stand without the safety belt significantly interfering with climbing movement of the tree stand.

Steps (a), (b), (c), and (e) may be practiced sequentially (that is in that order), and step (d) may be practiced at any time before step (e). Step (b) is typically practiced after passing the second end of the belt through the loop so that the clip at the second end of the belt is available for attachment to the user's harness. After climbing down the tree there is typically the further step of releasing the belt from the stand and curling up the belt for easy storage (e.g. in a generally spiral configuration). Step (c) may be practiced by affixing one or more spring clamps, clothes pins or clips, or elastic bands to the safety belt and support bars or the tree gripping element remote from the stiffening element, or using elements mounted on or forming a part of the stand side supports.

According to another aspect of the present invention there is provided a climbing tree stand and safety belt combination, which comprises the following elements: A climbing tree stand having a frame portion with a tree engaging element having inner and outer surfaces, and side supports for the frame portion. A safety belt body of webbing, and having first and second ends cooperating to attach the belt body to a human using the tree stand. The safety belt body encircling the outer surface of the tree engaging element; and means for releasably attaching the belt body to the side supports or the tree engaging element so that the belt body does not significant interfering with climbing movement of the tree stand. The means for releasably attaching the belt body to the side supports or the tree engaging element may be any one of the elements as described above, or their equivalents.

It is the primary object of the present invention to facilitate safe use of a climbing tree stand, particularly when the user is climbing up or down a tree. This and other objects of the invention will become clear from the detailed description of the invention and from the appended claims.

DETAILED DESCRIPTION OF THE DRAWINGS

Figure 1:
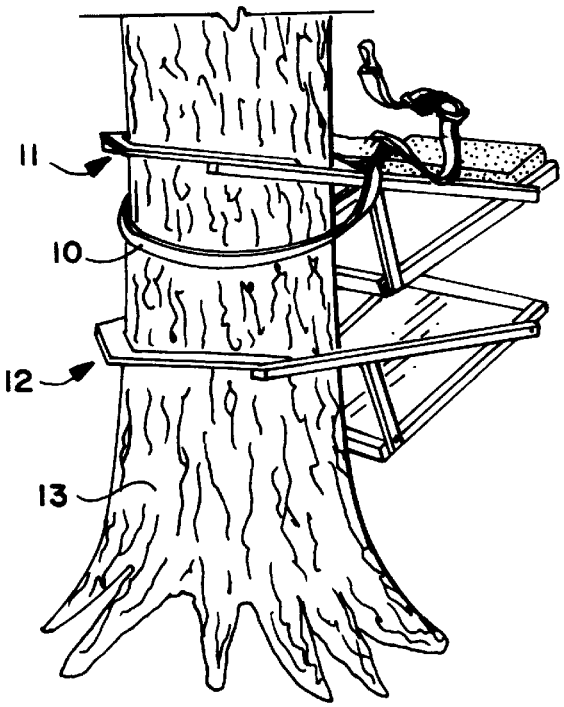
Fig. 1 (Prior Art)
FIG. 1 is a schematic detail view showing an exemplary prior art safety belt in use with a tree stand during climbing action, and indicating how the safety belt can interfere with climbing action.

FIG. 1 schematically illustrates a prior art safety belt 10 in association with a conventional climbing tree stand having an upper frame 11 and a lower frame 12. A conventional safety belt 10 is made out of a cloth-like material, such as conventional polyester or nylon webbing and typically having a width of about two inches. The belt 10 loops around the tree 13, one end thereof passing through a loop in the other end and connecting to a conventional safety harness worn by the user of the tree stand. As seen in FIG. 1, because of the flexible nature of the belt 10 it can move up and down the tree as the user ascends or descends the tree 13, and can easily interfere with the climbing action of the upper frame 11, or even the lower frame 12.

Figure 2:
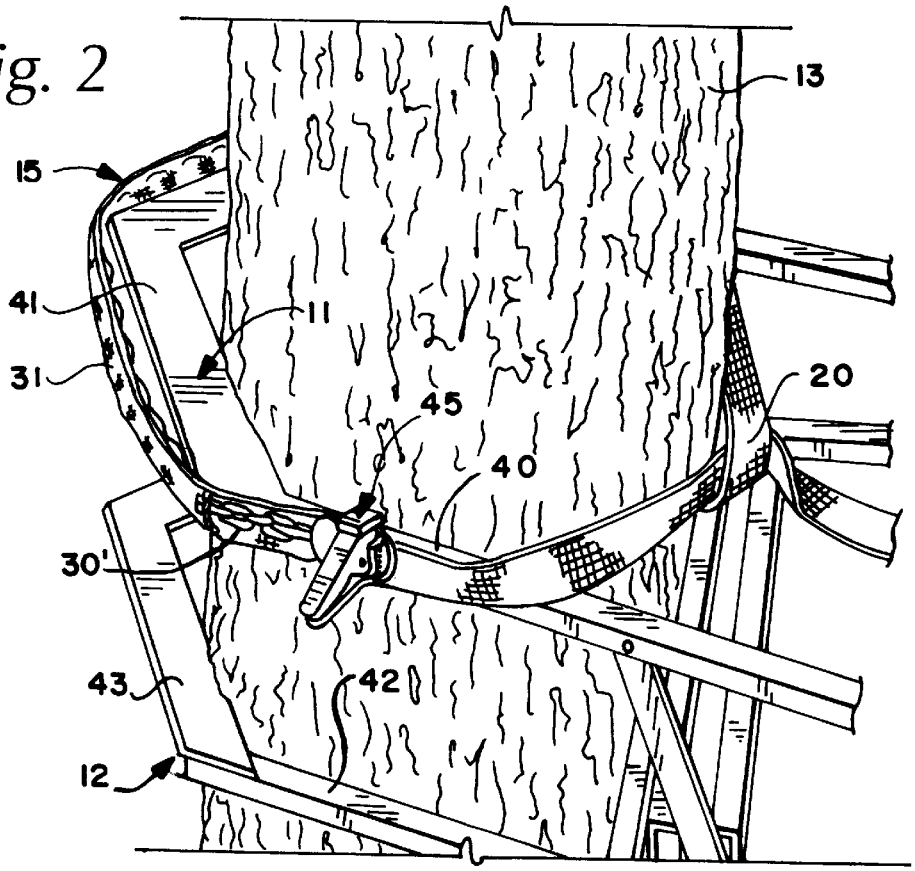
FIG. 2 is a perspective view showing an exemplary safety belt according to the present invention in association with a tree stand during climbing, and illustrating that the belt does not interfere with climbing action.
Figure 3:
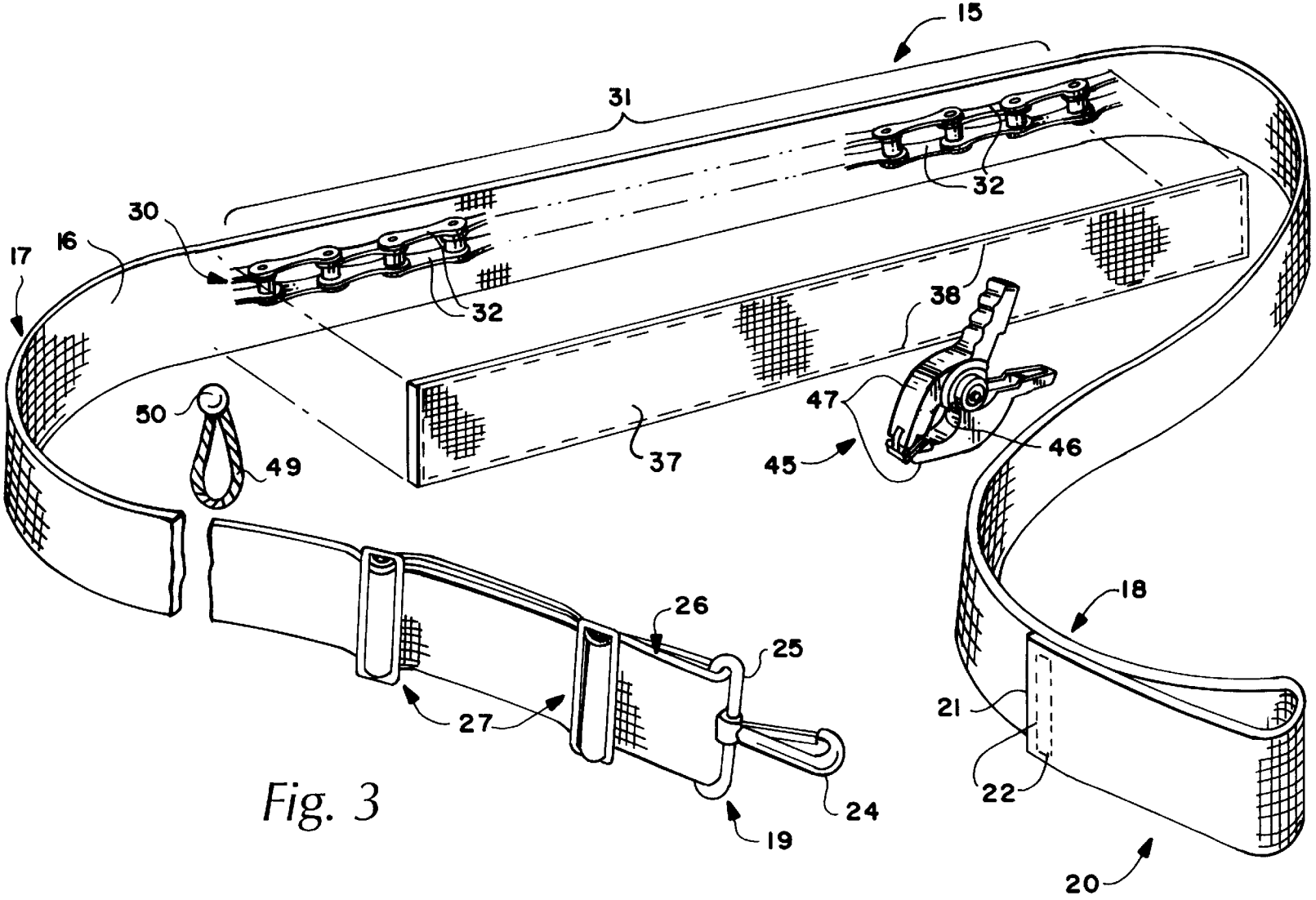
FIG. 3 is an exploded perspective view of an exemplary safety belt according to the present invention.

FIGS. 2 and 3 illustrate an exemplary safety belt according to the present invention, shown generally by reference numeral 15. In the preferred embodiment of the safety belt 15 that is illustrated in FIGS. 2 and 3, it has many features in common with the prior art belt of FIG. 1. In particular it has a body 16 comprising a flexible web of cloth-like material (such as polyester, cotton, aramid, or nylon webbing), having a width 17 (typically between about 1.5–4 inches, e.g. about two inches), with a first end 18 and a second end 19 (see FIG. 3). At the first end 18 preferably a loop 20 is formed, such as by turning back the free end 21 of the body 16 and stitching it—as indicated by stitches 22—or otherwise affixing it to the bottom 16 to form the loop 20. The loop 20 is large enough to receive the second 19 of the body 16 therethrough. The second end 19 includes an attachment device, such as a conventional clip 24 connected by a metal ring 25 to a looped portion 26 of the belt body 16. Conventional adjustment buckles 27 are provided for allowing adjustment of the effective length of the body 16.

What is different about the belt 15 according to the present invention compared to conventional belts is the provision of a stiffening element, shown generally by reference numeral 30 in FIG. 3, at a central portion 31 of the belt 15 (between the ends 18, 19). In the preferred embodiment illustrated in FIG. 3, the stiffening element 30 comprises a metal chain, typically of steel or stainless steel having links 32. The chain 30 may be of the type illustrated in FIG. 3, which is sold by John Deere Company for use in farm planting equipment, and is of the type used by API Outdoors Inc. of Tallulah, La. in API's conventional climbing tree stands. The chain 30 links 32 are pivotally connected together to articulate when rolled up, but are stiff along the pivot axes. The chain 30 typically has a length of between about 3.5–4.5 feet.

Figure 4:
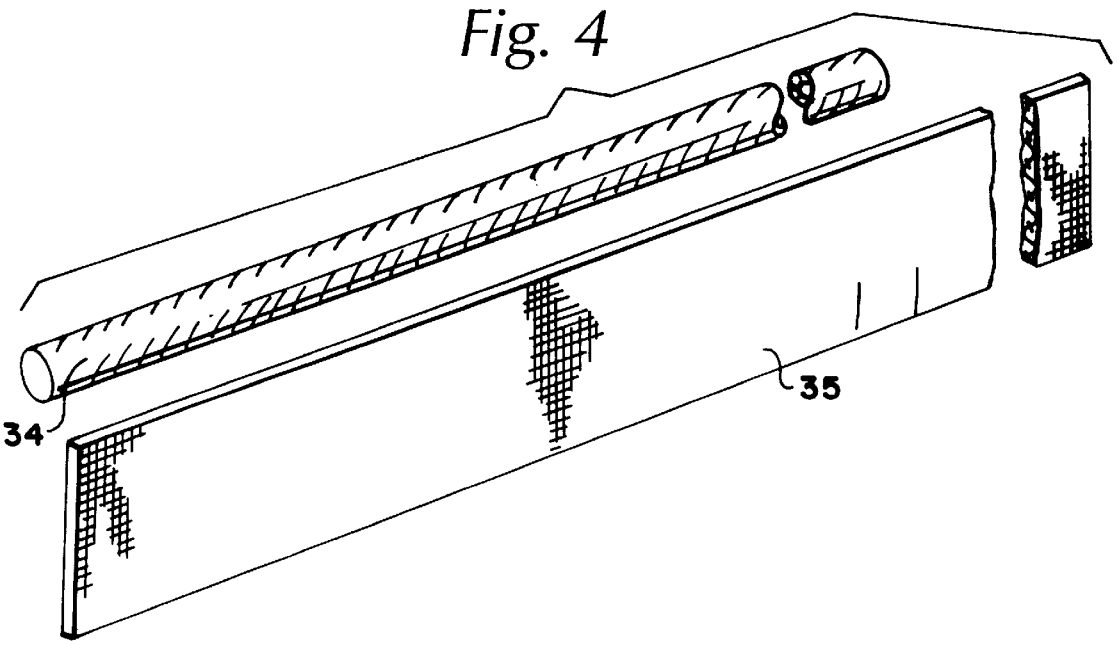
FIG. 4 is a perspective view of alternative stiffening elements that may be used with the safety belt of FIG. 3.

Other types of conventional metal chain—as illustrated at 30' in FIG. 2—also could be used. Alternatively the stiffening element 30 may be a plastic chain, or—as illustrated in FIG. 4—a cable (e.g. a steel cable) length 34 (about the same length as the chain 30 in FIG. 3), or a generally rectangular strip 35, also having approximately the same length as the chain 30 in FIG. 3. The strip 35 may be of metal or plastic, such as thin yet self-supporting metal or plastic banding material. Other stiffening elements (such as multiple thicknesses of webbing, or cellulose based material—like cardboard—between pieces of webbing, or reinforced rubber hose, or jumper cable) could also be provided as long as they make the central portion 31 of the belt 15 generally self-supporting, and preferably so that they also still allow curling of the belt body 16 into a generally spiral configuration for easy transport and storage.

In the preferred embodiment illustrated in FIG. 3, the stiffening element 30 (or 34, 35, etc.) is connected to the belt body 16. For example this connection can be accomplished by utilizing a strip 37 of webbing, which may be of the same material and have substantially the same width as the body 16. The webbing 37 has a length slightly greater than the length of the chain 30 and is affixed, for example, by stitching 38, to the central portion 31 of the belt body 16 so that the stiffening element 30 is sandwiched between the strip 37 and the central portion 31 of the belt body 16.

The provision of a stiffening element at a central portion of the belt body 16 may be accomplished in many other ways. For example the entire central portion 31 of the belt 15 may be made of a stiffening element, such as the strip 35, and connected by any suitable fastening components to the rest of the belt body 16; or the stiffening elements may be connected by metal fasteners, or by adhesive, to the central portion 31 of the belt body 16. The use of the strip of webbing 37 is preferred because it is not only aesthetically pleasing (hiding the stiffening element 30, 34, 35, itself but also minimizes the possibility of the stiffening element making noise, and positively retains it in a desired position for essentially the entire life of the belt 15.

Also according to the present invention the safety belt 15 is typically provided in combination with a climbing tree-upperd having an upper frame 11, with means for releasably attaching the belt body 16 to at least one side support of the upper frame 11. FIG. 2 shows the conventional construction of the upper frame 11, and lower frame 12, of a conventional tree stand. The upper frame 11 typically includes a pair of side supports 40, only one of which is visible in FIG. 2, and a tree gripping or engaging element 41. The lower frame 12 typically has similar side supports 42 and a tree gripping or engaging element 43. It is to be understood that the invention can be used with essentially any type of climbing tree stand, such as shown in U.S. Pat. Nos. 5,234,076 or 5,588.499, and such as marketed by a wide variety of companies such as API Outdoors Inc. of Tallulah, La., L&L Enterprises, Inc. of Leakesville, Miss., Loggy Bayou of Shreveport, La., and Cabela's of Sidney, Nebr. The details of the climbing tree stand and its operation are entirely conventional and not part of this invention.

According to the present invention it is desirable to attach the belt 15 to at least one of the side supports 40, preferably to both side supports, or to one or more different locations on gripping element 41. The means for releasably attaching the belt body 16 to the side supports 40 or element 41 may comprise a wide variety of structures. The releasable attaching means, depending upon its construction and that of the body 16, may attach the body 16 at the central portion 31, or remote from the stiffening element 30, such as immediately adjacent the stiffening element 30 as illustrated in FIG. 2. In some cases attachment of the body 16 to the side supports 40, or to element 41, may obviate the need for a stiffening element (e.g. 30).

FIG. 2 shows the releasable attaching means as a conventional spring clamp 45, and a similar form of the spring clamp 45 (including the spring 46 and pivotally connected components 47) is seen in FIG. 3. For example a conventional alligator clip or clamp, like that used in conventional jumper cables, or preferably of the type sold by Michigan Industrial Tools (MIT) under the trade designation 3912 and called "6 Inch Supergrip Spring Clamp W/Flexible Pad", may be used as the clamp 45. Alternatively the releasable attaching means may comprise a conventional clothes pin or clip, cooperating hook and loop fastener strips (VELCRO), or an elastic band 49 (see FIG. 3) in a loop configuration with a holding projection 50, such as of the type sold for use in holding long hair in place on a human's head.

MIT spring clamps, like the clamp 45 illustrated in the drawings, are preferred since they positively hold the belt 15 yet can be easily positioned to insure that they release the belt 15 if the user falls, so that the belt 15 is held securely against the tree 13 by the weight of the user. The clamps 45 hold the belt 15 about one-half inch from the tree 13 to allow freedom from impingement.

Figure 5:
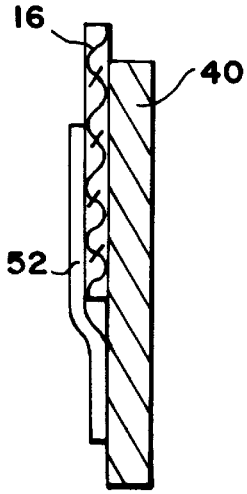
FIG. 5 is a longitudinal cross-sectional view showing a possible alternative embodiment of an attachment means for releasably attaching the safety belt of the invention to a tree stand.

If desired the releasable attaching means may be constructed or provided directly in association with the side supports 40, for example an elastic band provided over the side support 40 through which the belt ends 18, 19 are passed, or one or more belt engaging metal flanges 52 (see FIG. 5) welded or otherwise attached to the outside of a side support 40. (The flanges 52 may be spring biased toward the side support 40, if desired, e.g. by making the flange 52 of spring steel or the like.) Any suitable conventional structure may be provided as the releasable attaching means for attaching the belt body 16 to at least one of the side supports 40 as long as detachment is fairly easy but attachment is secure enough so that it can be insured (typically combined with the stiffening action of the stiffening element 30, 34, 35) that the belt 15 will not interfere with the climbing action.

FIG. 2 shows one exemplary use of the belt 15 in association with the tree stand upper frame 11. As can be seen in FIG. 2 after the tree stand is placed in association with the tree 13 so that the side supports 40, 42 of the upper and lower frames 11, 12 substantially straddle the tree 13, and the tree gripping elements 41, 43 are positioned to engage the tree 13, the stiffening element (e.g. 30) at the central portion 31 of the safety belt 15 is placed around the tree 13 and outside of and substantially in contact with the upper frame tree gripping element 11. The safety belt 15 is also preferably releasably connected, as by the spring clamp 45 seen in FIG. 2 (with a like spring clamp 45 provided in association with the other side support 40 of the tree stand upper frame 11), to at least one side support 40, and preferably both supports 40, of the upper frame 11. The safety belt second end 18 will have already been passed through the loop 20 in the first end 18, as illustrated in FIG. 2, and the clip 24—or other attachment device—will then be operatively attached to the human using the tree stand, as by clipping onto a D-ring or the like on a conventional safety harness worn by the user. Then the user will climb up or down the tree using the tree stand frames 11, 12 in the conventional manner while the safety belt 15 is operatively attached to the human using the tree stand.

The placement of the safety belt 15 around the tree gripping element 11, and the releasable connection of the safety belt 15 (typically remote, but adjacent, the central stiffened section 31) are practiced so as to facilitate climbing of the tree with the tree stand by the human without the safety belt 15 significantly interfering with climbing movement of the tree stand. The relatively rigid configuration of the central portion 31 of the safety belt 15 will ensure that it does not "flop" so that it can get between the element 41 and the tree 13, and the desired further or alternative provision of the releasable attachment means, such as the spring clamps 45, to hold the belt 15 in place, will ensue no significant interference of the belt 15 with the climbing action. However the belt 15 typically is not so securely held by the spring clamps 45, or other releasable attachment means, so that the safety function of the belt is interfered with, which desirably—although not necessarily—includes detachment of the belt 15 from the frame 11.

Once the user is at the desired height in the tree 13, supported by the stand 11, 12, the clamps 45 are removed and the strap 15 is secured closer to the tree 13. The clamps 45 may simply remain in contact with bars 40 or element 41 Oust without the strap 15 held thereby). The clamps 45 are reattached to belt 15 and the belt 15 loosened to begin descent.

It will thus be seen that according to the present invention a tree stand safety belt, and a method of facilitating a human safety ascending or descending a tree using a climbing tree stand, have been provided which are advantageous compared to the prior art. The tree stand safety belt according to the present invention will not significantly interfere with climbing movement of the tree stand, but preferably still allows the belt body to be curled up (e.g. in a spiral configuration) for ease of storage and transport. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A tree stand safety belt for use by a human user in combination with a climbing tree stand having an upper frame with side supports and a tree engaging element, comprising:

a belt body comprising a flexible web of cloth like material and having first and second ends, said belt having a length long enough to pass substantially completely around a tree and to be operatively attached to a human user so as to act as a tree stand safety belt;

said ends of said belt body attachable to a human tree stand user;

a stiffening element at a central portion of said belt body between said first and second ends that stiffens said web to facilitate climbing of a tree with the tree stand without significantly interfering with climbing movement of the tree stand, while allowing said belt body to be curled up when not in use; and means for releasably attaching said belt body to at least one of said side supports of said tree engaging element, comprising cooperating hook and loop fasteners.

2. A tree stand safety belt as recited in claim 1 wherein said stiffening element comprises a chain connected to said belt body.

3. A tree stand safety belt as recited in claim 2 wherein said chain is connected to said belt body by a strip of webbing fixed to said belt body and sandwiching said chain between said strip and said belt body.

4. A tree stand safety belt as recited in claim 3 wherein said strip of webbing is fixed to said belt body by stitching.

5. A tree stand safety belt as recited in claim 4 wherein said belt body comprises polyester, cotton, aramid, or nylon webbing between about 1.5–4 inches wide, and said strip of webbing is polyester, cotton, aramid, or nylon webbing having an effective width of about 1.5–4 inches.

6. A tree stand safety belt as recited in claim 1 wherein said stiffening element is connected to said belt body by a strip of webbing fixed to said belt body and sandwiching said stiffening element between said strip and said belt body.

7. A tree stand safety belt as recited in claim 6 wherein said strip of webbing is fixed to said belt body by stitching.

8. A tree stand safety belt as recited in claim 6 wherein said stiffening element comprises a generally rectangular strip of metal or plastic.

9. A tree stand safety belt as recited in claim 1 further comprising a loop formed at said first end of said belt body that allows said second end to pass therethrough.

10. A tree stand safety belt as recited in claim 9 further comprising a clip connected to said belt body second end by a connection that allows adjustment of effective belt length.

11. A tree stand safety belt as recited in claim 9 wherein said loop is formed by fastening one part of said belt body to another at said first end.

12. A method of facilitating a human safely ascending or descending a tree using a tree stand having upper and lower frames each with side supports and a tree gripping element, and a safety belt connectable to the human, and the safety belt comprising a belt body comprising a flexible web of cloth like material and having first and second ends and a stiffening element at a central portion of said belt body between said first and second ends that stiffens the web, said method comprising the steps of:

(a) placing the tree stand in association with a tree so that the side supports of the upper and lower frames straddle the tree and the tree gripping elements are positioned to engage the tree;

(b) placing the stiffening-element-having central portion of the safety belt around the tree;

(c) releasably connecting the safety belt to at least one side support or the tree gripping element of the upper frame of the tree stand with coopering hook and loop fastener;

(d) operatively attaching the safety belt to the human using the tree stand; and (e) climbing up or down the tree using the tree stand while the safety belt is operatively attached to the human using the tree stand; and wherein steps (b) and (c) are practiced so as to facilitate climbing of the tree with the tree stand without the safety belt significantly interfering with climbing movement of the tree stand.

13. A method as recited in claim 12 wherein steps (a), (b), (c) and (e) are practiced sequentially.

14. A method as recited in claim 13 wherein step (d) is practiced at any time before step (e), and comprising the further step, after climbing down the tree, of releasing the belt from the stand and curling up the belt for easy storage.

15. A method as recited in claim 12 wherein step (c) is practiced by affixing one or more spring clamps to the safety belt and support bars or tree gripping element remote from the stiffening element.

* * * * *